US009944862B2

(12) United States Patent
Kasliwal et al.

(10) Patent No.: US 9,944,862 B2
(45) Date of Patent: Apr. 17, 2018

(54) PROCESS AND A SYSTEM FOR ENHANCING LIQUID YIELD OF HEAVY HYDROCARBON FEEDSTOCK

(71) Applicant: INDIAN OIL CORPORATION LIMITED, Mumbai (IN)

(72) Inventors: Pankaj Kumar Kasliwal, Faridabad (IN); Kuvettu Mohan Prabhu, Faridabad (IN); Arumugam Velayutham Karthikeyani, Faridabad (IN); Bandaru Venkata Hariprasadgupta, Faridabad (IN); Balaiah Swamy, Faridabad (IN); Biswanath Sarkar, Faridabad (IN); Brijesh Kumar, Faridabad (IN); Santanam Rajagopal, Faridabad (IN); Ravinder Kumar Malhotra, Faridabad (IN)

(73) Assignee: INDIAN OIL CORPORATION LIMITED, Mumbai (IN)

( * ) Notice: Subject to any disclaimer, the term of this patent is extended or adjusted under 35 U.S.C. 154(b) by 0 days.

(21) Appl. No.: 15/036,051

(22) PCT Filed: Jan. 6, 2014

(86) PCT No.: PCT/IB2014/058072
§ 371 (c)(1),
(2) Date: May 11, 2016

(87) PCT Pub. No.: WO2015/071774
PCT Pub. Date: May 21, 2015

(65) Prior Publication Data

US 2016/0281002 A1 Sep. 29, 2016

(30) Foreign Application Priority Data

Nov. 18, 2013 (IN) ..... 3604/MUM/2013

(51) Int. Cl.
*C10G 9/32* (2006.01)
*C10G 9/00* (2006.01)
*C10G 9/26* (2006.01)

(52) U.S. Cl.
CPC ..... *C10G 9/005* (2013.01); *C10G 9/26* (2013.01); *C10G 9/32* (2013.01)

(58) Field of Classification Search
CPC ..... C10G 9/005; C10G 9/32
See application file for complete search history.

(56) References Cited

U.S. PATENT DOCUMENTS 1,831,719 A 11/1931 Pelzer
2,636,844 A 4/1953 Kimberlin, Jr. et al.
4,097,243 A * 6/1978 Bartholic ..... B01J 8/0278 208/113
4,161,442 A 7/1979 Audeh et al.
4,232,514 A 11/1980 Flatt
4,252,634 A 2/1981 Khulbe et al.
4,263,128 A 4/1981 Bartholic
4,294,686 A 10/1981 Fisher et al.
4,311,580 A 1/1982 Bartholic
4,378,288 A 3/1983 Shih et al.
4,427,539 A 1/1984 Busch et al.
4,435,272 A 3/1984 Bartholic et al.
4,490,243 A 12/1984 Miyauchi et al.
4,569,753 A 2/1986 Busch et al.
4,578,183 A 3/1986 Chou et al.
4,624,771 A * 11/1986 Lane ..... C10G 11/18 208/113
4,668,378 A 5/1987 Miyauchi et al.
4,772,378 A 9/1988 Miyauchi et al.
4,818,373 A 4/1989 Bartholic et al.
4,832,823 A 5/1989 Goyal et al.
4,929,338 A * 5/1990 Wormsbecher ..... B01J 29/084 208/108
4,980,045 A 12/1990 Krishna et al.
4,985,136 A 1/1991 Bartholic
5,039,390 A 8/1991 Hampp et al.
5,296,131 A 3/1994 Raterman
5,413,702 A 5/1995 Yan
5,616,237 A * 4/1997 Krishna ..... C10G 11/18 208/113
5,660,716 A * 8/1997 Bourgogne ..... C10G 11/05 208/113
5,662,868 A 9/1997 Letzsch et al.
5,723,040 A 3/1998 Letzsch et al.
5,853,565 A 12/1998 Cayton
6,860,985 B2 3/2005 Siskin et al.
7,303,664 B2 12/2007 Siskin et al.
7,374,665 B2 5/2008 Eppig et al.
7,645,735 B2 1/2010 Folkman et al.
7,658,838 B2 2/2010 Varadaraj et al.
7,914,668 B2 3/2011 Siskin et al.
8,105,482 B1 1/2012 Freel et al.
(Continued)

FOREIGN PATENT DOCUMENTS

EP 0 028 666 A1 5/1981
GB 559 026 A 2/1944
(Continued)

*Primary Examiner* — Randy Boyer
(74) *Attorney, Agent, or Firm* — Maschoff Brennan

(57) ABSTRACT

The present invention provides a process and a system for coking and simultaneous upgrading of a heavy hydrocarbon feedstock. More particularly the present invention relates to a process of cracking heavy hydrocarbon feedstock employing high heat carrier, incorporated with weak acid sites for improving the liquid yield and reducing coke yield. The feedstock is vaporized and brought in contact with a heat carrier material to produce a product stream and separating the product stream from the particulate heat carrier, regeneration of the particulate heat carrier to the extent of 10-30% and collecting a gaseous and liquid product from the product stream.

22 Claims, 2 Drawing Sheets

(56) References Cited

U.S. PATENT DOCUMENTS

| | | | |
|---|---|---|---|
| 8,147,676 | B2 | 4/2012 | Siskin et al. |
| 8,206,574 | B2 | 6/2012 | Etter |

FOREIGN PATENT DOCUMENTS

| | | | | | |
|---|---|---|---|---|---|
| GB | 724 213 | A | | 2/1955 | |
| GB | 724213 | A | * | 2/1955 | ..... C10B 55/10 |
| GB | 753 799 | A | | 8/1956 | |

* cited by examiner

PROCESS AND A SYSTEM FOR ENHANCING LIQUID YIELD OF HEAVY HYDROCARBON FEEDSTOCK

FIELD OF INVENTION

The present invention provides a process and a system for coking and simultaneous upgrading of a heavy hydrocarbon feedstock. More particularly the present invention relates to a process of cracking heavy hydrocarbon feedstock employing high heat carrier, incorporated with weak acid sites for improving the liquid yield and reducing coke yield. More specifically, this invention relates to the use of coking process in order to enhance the liquid yield whenever heavier feed stocks feed containing high CCR (Conradson Carbon Residue), Metals such as Nickel, vanadium and Asphaltenes are to be processed. The feedstock is vaporized and brought in contact with a heat carrier material to produce a product stream and separating the product stream from the particulate heat carrier, regeneration of the particulate heat carrier to the extent of 10-30% and collecting a gaseous and liquid product from the product stream. The present invention relates to process of cracking heavier hydrocarbon feedstock to achieve desired yields thereby maximizing the liquid yield and reducing the coke yield.

BACKGROUND OF INVENTION

Demand for transportation fuels coupled with increased crude prices and deteriorating quality have forced refiners for enhancing liquid yields at the same time decrease the yield of undesired products like coke and dry gas. Delayed Coker is one of the major non-catalytic work horse of refining industry for the production of LPG, olefinic naphtha, diesel and heavy oil operating on the principle of free radical mechanism with rejection of coke. The delayed coking process has evolved with many improvements since the mid-1930s. Delayed coking is a semi-continuous process in which the heavy feedstock is heated to a high temperature. The first patent for this technology is U.S. Pat. No. 1,831,719, which discloses cracking of the hot vapor mixture in the coking receptacle before its temperature falls below 950° F. The heavy residua feed is thermally cracked in the drum to produce lighter hydrocarbons and solid, petroleum coke. This process is conducted in batches with operation time of 6-12 hrs. The main concern of refining industry is higher batch time cycle and higher coke yield. There have been continuous efforts in enhancing liquid yield with reduction in coke. In delayed coking, substantial amount of volatile matter still remains on coke which determines the overall economy of the process. The hardness of coke can be a rough measure of efficiency of the process. Lower the volatile material in the petroleum coke, higher the hardness and thus higher liquid yields. Various petroleum coke uses have specifications with volatile matter less than 12 wt %. The note worthy commercial processes which focuses towards reduction in volatile matter the coke are Fluid coking and Flexi coking developed by Exxon Mobil. Fluid Coking®, developed since the late 1950s, is a continuous coking process that uses fluidized solids to increase the conversion of coking feedstocks to cracked liquids, and further reduce the volatile content of the product coke, In Fluid Coking®, the coking feedstock blend is sprayed into a fluidized bed of hot, fine coke particles in the reactor. Heat for the endothermic cracking reactions is supplied by the hot particles, this permits the cracking and coking reactions to be conducted at higher temperatures (about 480-565° C.) and shorter contact times than in delayed coking. The Fluid Coking technology reduces the volatile combustible matter within 4-10wt %. Flexicoking® is an improvement of the Fluid Coking® process, in which a third major vessel is added to gasify the product coke.

Heavy Oil and bitumen are supplementing the decline in the production of conventional light and medium crude oil, and production from these resources is expected to dramatically increase. Presently, heavy oil and bitumen are made transportable by addition of diluents. However, diluted feedstock's are different from conventional crude oils. As a results, bitumen blends or synthetic crudes are not easily processed in conventional fluid catalytic cracking process. Therefore in either of cases refiner must be configured to handle either diluted or upgraded feedstock.

Many heavy hydrocarbon feedstocks are also characterized as comprising significant amounts of BS&W (bottom sediment and water). Such feedstocks are not suitable for transportable by pipeline, or upgrading due to the sand, water and corrosive properties of the feedstock. Typically, feedstocks characterized as having less than 0.5 wt. % BS&W are transportable by pipeline, and those comprising greater amount of BS&W require some degree of processing and treatment to reduce the BS&W content prior to transport. Such processing may include storage to let the water and particulates settle, followed by heat treatment to drive of water and other components. However, these manipulations are expensive and time consuming There is therefore a need within the art for an efficient method for upgrading feedstock comprising a significant BS&W content prior to transport or further processing of the feedstock.

Heavy oils and bitumens can be upgraded using a range of rapid processes including thermal (e.g., U.S. Pat. Nos. 4,490,243; 4,294,686; and 4,161,442), hydrocracking (U.S. Pat. No. 4,252,634) visbreaking (U.S. Pat. Nos. 4,427,539; 4,569,753; and 5,413,702) or catalytic cracking (U.S. Pat. Nos. 5,723,040; 5,662,868; 5,296,131; 4,985,136; 4,772,378; 4,668,378, and 4,578,183) procedures. Several of these processes, such as visbreaking or catalytic cracking, utilize either inert or catalytic particulate contact materials within upflow or downflow reactors. Catalytic contact materials are for the most part zeolite based (see for example U.S. Pat. Nos. 5,723,040; 5,662,868; 5,296,131; 4,985,136; 4,772,378; 4,668,378, 4,578,183; 4,435,272; and 4,263,128), while visbreaking typically utilizes inert contact material (e.g., U.S. Pat. Nos. 4,427,539; and 4,569,753), carbonaceous solids (e.g., U.S. Pat. No. 5,413,702), or inert kaolin solids (e.g., U.S. Pat. No. 4,569,753).

The use of fluid catalytic cracking (FCC), or other, units for the direct processing of bitumen feedstocks is known in the art. However, many compounds present within the crude feedstocks interfere with these processes by depositing on the contact material itself. These feedstock contaminants include metals such as vanadium and nickel, coke precursors such as Conradson carbon and asphaltenes, and sulfur, and the deposit of these materials results in the requirement for extensive regeneration of the contact material. This is especially true for contact material employed with FCC processes as efficient cracking and proper temperature control of the process requires contact materials comprising little or no combustible deposit materials or metals that interfere with the catalytic process.

To reduce contamination of the catalytic material within catalytic cracking units, pretreatment of the feedstock via visbreaking (U.S. Pat. Nos. 5,413,702; 4,569,753; and 4,427,539), thermal (U.S. Pat. Nos. 4,252,634; and 4,161,442) or other processes, typically using FCC-like reactors, operating at temperatures below that required for cracking the feedstock (e.g. U.S. Pat. Nos. 4,980,045; and 4,818,373 and U.S. Pat. No. 4,263,128;) have been suggested. These systems operate in series with FCC units and function as pre-treaters for FCC. These pretreatment processes are designed to remove contaminant materials from the feedstock, and operate under conditions that mitigate any cracking This ensures that any upgrading and controlled cracking of the feedstock takes place within the FCC reactor under optimal conditions.

Several of these processes (e.g. U.S. Pat. Nos. 4,818,373; 4,427,539; 4,311,580; 4,232,514; and 4,263,128;) have been specifically adapted to process "resids" (i.e. feedstocks produced from the fractional distillation of a whole crude oil) and bottom fractions, in order to optimize recovery from the initial feedstock supply. The disclosed processes for the recovery of resids, or bottom fractions, are physical and involve selective vaporization or fractional distillation of the feedstock with minimal or no chemical change of the feedstock. These processes are also combined with metals removal and provide feedstocks suitable for FCC processing. The selective vaporization of the resid takes place under non-cracking conditions, without any reduction in the viscosity of the feedstock components, and ensures that cracking occurs within an FCC reactor under controlled conditions. None of these approaches disclose the upgrading of feedstock within this pretreatment (i.e. metals and coke removal) process. Other processes for the thermal treatment of feedstocks involve hydrogen addition (hydrotreating) which results in some chemical change in the feedstock.

U.S. Pat. No. 4,378,288 relates a process for increasing coker distillate yield in a coking process by adding a small amount, generally 0.005-10% by weight of a free radical inhibitor selected from the group consisting of hydroquinone and N-phenyl-2-naphthylamine to the coker feed material.

U.S. Pat. No. 4,832,823 refers to an improved coking process is described wherein a feedstock comprising residual oil is passed into a coking zone along with a highly aromatic oil such as pyrolysis tars or a decanted oil produced from a fluidized catalytic cracking zone in a concentration resulting in the feedstock having from about 5 to about 20 percent by weight of highly aromatic oil. The yield of coke is thereby reduced.

U.S. Pat. No. 5,039,390 is directed to a composition and methods for controlling undesirable coke formation and deposition commonly encountered during the high temperature processing of hydrocarbons. Coke formation can be inhibited by adding a sufficient amount of a combination of a boron compound and a dihydroxyphenol.

U.S. Pat. No. 5,853,565 provides a method for controlling the relative proportion of products produced from a petroleum residuum by thermal coking. Coke yield promoting compounds are identified, and effective attenuating agents are specified. The method can mitigate a coke promoting effect induced by certain surfactants, antifoulants, or fugitive catalysts in thermal coking units. Mitigating the coke yield promoting effect of molybdenum, for example, in a thermal coker permits recovery of a greater proportion of distillate boiling range products.

U.S. Pat. No. 6,860,985 relates to a method for improving yield in petroleum streams derived from coking processes in flexicoking & fluidcoking. In a preferred embodiment, the invention relates to a method for regenerating filters employed to remove particulate matter from coker gas oil to improve coker gas oil yield and yield of upgraded coker gas oil products.

U.S. Pat. No. 7,303,664 refers to a process of delayed coking for making substantially free-flowing coke, preferably shot coke. in this process feedstock based on vacuum residuum, is heated in a heating zone to coking temperatures then conducted to a coking zone wherein volatiles are collected overhead and coke is formed. A metals-containing additive is added to the feedstock prior to it being heated in the heating zone.

U.S. Pat. No. 7,374,665 is concerning a method of blending delayed coker feedstocks to produce a coke that is easier to remove from a coker drum. A first feedstock is selected having less than about 250 wppm dispersed metals content and greater than about 5.24 API (American Petroleum Institute) gravity. A second delayed coker feedstock is blended with said first resid feedstock so that the total dispersed metals content of the blend will be greater than about 250 wppm and the API gravity will be less than about 5.24.

U.S. Pat. Nos. 7,658,838, & 7,645,735 relate to a delayed coking process for making substantially free-flowing coke, preferably shot coke from vacuum residuum with the help of addition of about 300 to about 3,000 wppm of polymeric additive.

U.S. Pat. No. 7,914,668 refers to a thermal conversion process for continuously producing hydrocarbon vapor and continuously removing a free-flowing coke. The coke, such as a shot coke, can be withdrawn continuously via, e.g., a staged lock hopper system.

U.S. Pat. No. 8,147,676 relates to an improved delayed coking process in which coker feed, such as a vacuum resid, is treated with (i) a metal-containing agent and (ii) an oxidizing agent. The feed is treated with the oxidizing agent at an oxidizing temperature. The oxidized feed is then pre-heated to coking temperatures and conducted to a coking vessel for a coking time to allow volatiles to evolve and to produce a substantially free-flowing coke. A metals-containing composition is added to the feed prior to the heating of the feed to coking temperatures.

The process disclosed in U.S. Pat. No. 8,105,482 reduces the viscosity of feedstock in order to permit the pipeline transport of upgraded feedstock with little or no addition of diluents. The process refers to pyrolysis in order to upgrade the viscosity of oil. Heat carrier is silica sand. This patent discloses ex situ regeneration of catalyst/heat carrier. Residence time is 2 s. Feed contains emulsion in water along with surfactants. It is oil/water emulsion with feed containing tar sand, bitumen, etc. at having at least 20 wt % CCR. Ratio of heat carrier to feed is high 10:1 to 200:1 and the process is Fixed bed process.

U.S. Pat. No. 8,206,574 refers to a reactor process added to a coking process to modify the quantity or yield of a coking process involving delayed coking, fluid coking, flexicoking, or other coking processes with additive comprising catalyst(s), seeding agent(s), excess reactant(s), quenching agent(s), carrier fluid(s), Which may alumina, silica, zeolite, calcium compounds, iron compounds, activated carbon, crushed pet coke in addition new catalyst, FCCU equilibrium catalyst, spent catalyst, regenerated catalyst. In the prior art process, some of the catalytic materials posses high acidic bronsted sites in case involvement of zeolitic materials which causes over cracking besides imposing limitation in strippability of unreacted feed and product molecules trapped in zeolite pores. Further, alumina & silica based material do not offer adequate sites for inducing cracking. There is a need within the art for a rapid and effective upgrading process of a heavy oil or bitumen feedstock that involves a high heat carrier incorporated with weak acid sites to obtain a product rich in liquid over the starting material. Ideally this process would be able to accommodate feedstocks comprising significant amounts of Feed CCR, Metal (Ni &V) and Asphaltenes.

From the various prior art coking processes it can be seen that, Fluid coking and Flexi coking processes are the dynamic and continuous while, delayed coker is a batch process. In the Fluid/Flexi coking volatile combustion matter can be brought in the range 4-10wt %, and this process has limitation in carrying required heat for sustaining endothermic cracking, vaporization reaction as well as providing required adequate strength acid sites. Though U.S. Pat. No. 8,206,574 refers to a coking process to modify the quantity or yield of a coking process involving additive comprising catalyst(s), seeding agent(s), excess reactant(s), quenching agent(s), carrier fluid(s), which may alumina, silica, zeolite, calcium compounds, iron compounds, activated carbon, crushed pet coke in addition new catalyst, FCCU equilibrium catalyst, spent catalyst, regenerated catalyst but is silent on type and strength of acid sites needed and their preparation.

OBJECT AND SUMMARY OF INVENTION

It is primary object of the present invention to provide a suitable process ad a reactor for thermal cracking capable of providing higher heat for sustaining of endothermic cracking reaction at the same time to provide weak acid sites for enhancing cracking of bulkier hydrocarbons for enhancing of liquid yields, reduction in coke.

Another object of the present invention is to provide a suitable shape catalyst capable of withstanding rigors of fluidization, transport, stripping steps and maintaining integrity of particles with adequate apparent bulk density (ABD) and attrition resistance.

Yet another object of the present invention is to provide required pore size, and surface area required for facilitating smooth entry and exit of reactants and products from the catalyst.

A further object of the present invention is to cut side branch of Poly Aromatic ring chain structure at the edge and reduce the coke make thereby increasing the liquid through use of a catalytic material having weak acid site that can easily be regenerated thereby enabling the process to convey adequate heat energy for sustaining continuous reaction. Such a material is prepared from modified clay selected from kaolinite, bentonite, illite, vermiculite, smectite, montmorillonite, sepiolite and hectorite. Natural beneficiated, milled clay can be in finely divided form with a size below about 5 microns. These clays having average pore diameter in the range of 20-100° A is capable of stripping hydrocarbon thereby resulting in lower coke make.

Accordingly, the present invention provides a process for coking and simultaneous upgrading of a heavy hydrocarbon feedstock, comprising:

(a) providing a heated particulate material to a reactor chamber;

(b) dispensing preheated heavy hydrocarbon feedstock in the reactor chamber such that the same comes in contact with the particulate material at a temperature in the range of 480° C. to 620° C.;

(c) allowing said heavy hydrocarbon feedstock to stay in contact with the particulate material for a predetermined time period to form a product mixture and a coke laden particulate material; and (d) withdrawing the product mixture from the reactor chamber;

characterized in that:

the preheated heavy hydrocarbon feedstock is dispensed as an atomized spray in the reactor chamber;

the predetermined time period is such that the product comprises about 70 wt % to about 80 wt % of hydrocarbons having boiling point in the range of about 40 to 600° C.

The present invention also provides a system for coking and simultaneous upgrading of a heavy hydrocarbon feedstock, comprising:

a reactor defining a chamber;

a particulate material supply means for supplying heated particulate material to the reactor chamber;

a hydrocarbon feedstock supply means for dispensing pre-heated heavy hydrocarbon feed stock to the reactor chamber such that the same comes in contact with the particulate material;

a product withdrawal means for withdrawing the product thus formed in the reactor chamber, characterized in that:

the hydrocarbon feed stock supply means dispenses the preheated heavy hydrocarbon feed stock as an atomized spray in the reactor chamber; and the reactor chamber allows the heated heavy hydrocarbon feedstock to stay in contact with the particulate material for a predetermined amount of time period such that the product comprises about 70 wt % to about 80 wt % of hydrocarbon having boiling point in the range of 40 to 600° C.

Figure 1:
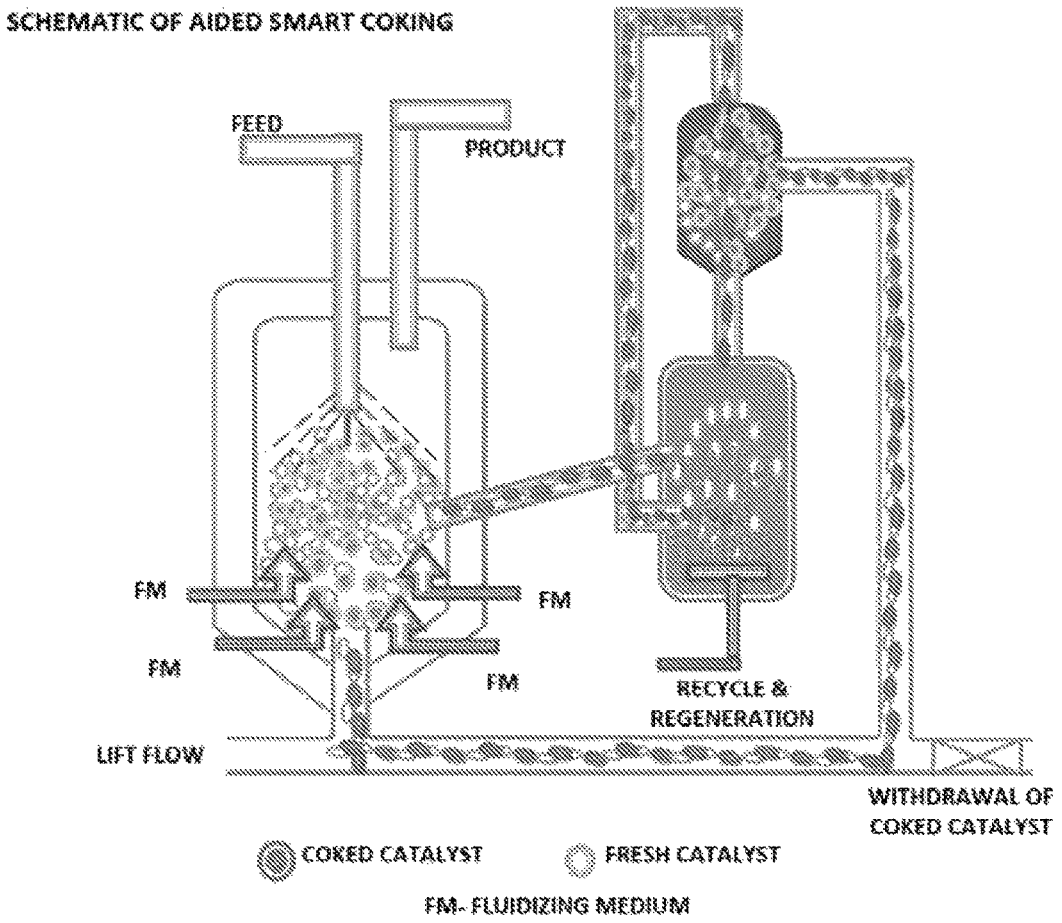
FIG. 1 illustrates process apparatus of the invention.

The above and other aspects of the present invention are further attained and supported by the following embodiments described herein. However, the described embodiments are in accordance with the best mode of practice and the scope of the invention is not restricted to the described embodiments herein after.

DETAILED DESCRIPTION OF INVENTION

While the invention is susceptible to various modifications and alternative forms, specific embodiment thereof will be described in detail below. It should be understood, however that it is not intended to limit the invention to the particular forms disclosed, but on the contrary, the invention is to cover all modifications, equivalents, and alternative falling within the scope of the invention as defined by the appended claims.

The present invention relates in o process of cracking heavy hydrocarbon feedstock employing high heat carrier, incorporated with weak acid sites for improving the liquid yield and reducing coke yield. More specifically, this invention relates to the use of coking process in order to enhance the liquid yield whenever heavier feed stocks i.e feed containing high CCR (Conradson Carbon Residue), Metals such as Nickel, vanadium and Asphaltenes are to be processed. The process employs upgrading heavy feedstock to valuable liquid products with increase in Total Cycle Oil (TCO) yield and reduction in CLO Clarified Oil (CU)) yield.

Accordingly, the present invention provides a process for coking and simultaneous upgrading of a heavy hydrocarbon feedstock, comprising:

(a) providing a heated particulate material to a reactor chamber;

(b) dispensing preheated heavy hydrocarbon feedstock in the reactor chamber such that the same comes in contact with the particulate material at a temperature in the range of 480° C. to 620° C.;

(c) allowing said heavy hydrocarbon feedstock to stay in contact with t .e particulate material for a predetermined time period to form a product mixture and a coke laden particulate material; and (d) withdrawing the product mixture from the reactor chamber;

characterized in that:

the preheated heavy hydrocarbon feedstock is dispensed as an atomized spray in the reactor chamber;

the predetermined time period is such that the product comprises about 70 wt % to about 80 wt % of hydrocarbons having boiling point in the range of about 40 to 600° C.

In one embodiment of the present invention, the particulate material has specific area in the range of 100 to 200 $m^2$/gm; Heat capacity in the range of 0.9 to 1.0 KJ/Kg ° C.; acidity of more than mass equivalent per gram and apparent bulk density (ABD) of 0.7 to 1.0 gm/cc.

More particularly, the catalyst for cracking heavy hydrocarbons comprises a clay material, silica alumina binder and matrix, wherein the catalyst is having surface area between 100-200 $m^2$/gm, heat capacity 0.9-1, ABD of 0.7 to 1 g/cc, acidity of 0.35 meq/gm.

In an embodiment of the present invention, the particulate material comprises a modified clay component, a binder component and optionally a diluent material, wherein the binder has less than 0.1 wt % of soda.

In another embodiment of the present invention, the modified clay is selected from modified kaolinite, modified bentonite, modified illite, modified vermiculite, modified smectite, modified montmorillonite, modified sepiolite, modified hectorite and mixtures thereof.

In yet another embodiment of the present invention, the binder is selected from the group comprising of alumina and the alumina is selected from alumina gel, psedobohemite, aluminium trihydrate, eta, theta and gamma.

In still another embodiment of the present invention, the diluent material is selected from non-modified clay, silica, and aluminium trihydrate.

In yet another embodiment of the present invention, the predetermined time period is in excess of about 60 seconds.

In still another embodiment of the present invention, the predetermined time period is maintained in the range of about 60 to about 900 seconds.

In yet another embodiment of the present invention, the predetermined time period is maintained in the range of about 60 to about 600 seconds.

In still another embodiment of the present invention, the predetermined time period is maintained in the range of about 60 to about 300 seconds.

In another embodiment of the present invention, a temperature during the predetermined period is maintained in the range of about 480° C., to 590° C.

In yet another embodiment of the present invention, an amount of preheated heavy hydrocarbon feedstock provided to the reactor chamber is such that a loading ratio of said heated particulate material to said preheated heavy hydrocarbon feedstock is in the range of 4:1 to 20:1.

In another embodiment of the present invention, the heavy hydrocarbon feedstock has a CCR content in excess of about 20 wt %.

In still another embodiment of the present invention, the heavy hydrocarbon feedstock is selected from the group comprising of heavy oil, bitumen or mixtures thereof.

In another embodiment of the present invention, the process further comprises separating the product mixture to obtain a light fraction and a heavy fraction and optionally recirculating at least a part of the heavy fraction to the reactor chamber.

In yet another embodiment of the present invention, the step of separating the product mixture to obtain a tight fraction and a heavy fraction is performed in a condenser.

In another embodiment of the present invention, the process further comprises regenerating at least a part of the coke laden particulate material and recirculating the regenerated particulate material to the reactor chamber.

In another embodiment of the present invention, the process further comprises controlling a velocity of the coke laden particulate material and/or controlling a velocity of regenerated particulate material.

In another embodiment of the present invention, the velocity of the coke laden particulate material is reduced using a first cyclone device and the velocity of the regenerated particulate material is reduced using a second cyclone device.

In one embodiment of the present invention, the first and the second cyclone device are the same.

In another embodiment of the present invention, the process comprises 10 to 30 wt % of the coke laden particulate material is regenerated and recirculated to the reactor chamber.

In another embodiment of the present invention, the process comprises the reactor chamber is in the form of an upflow reactor.

In one embodiment of the present invention, the step of providing a particulate material to the reactor chamber comprises maintaining the particulate material in form of a fluidized bed in the reactor chamber.

In yet another embodiment of the present invention, the process comprises maintaining the particulate material in form of a fluidized bed in the reactor chamber comprises feeding a fluidizing medium via at least one inlet located at a first elevation of the reactor chamber and feeding the particulate material via at least one inlet located at a second elevation of the reactor chamber.

In still another embodiment of the present invention, the process comprises the step of dispensing preheated heavy hydrocarbon feedstock in the reactor chamber having dispensing the heavy hydrocarbon feedstock as an atomized spray from at least a top surface of the reactor chamber.

In another embodiment of the present invention, the process comprises the step of dispensing preheated heavy hydrocarbon feedstock in the reactor chamber comprises dispensing the heavy hydrocarbon feedstock as an atomized spray from a plurality of elevations within the reactor chamber.

In another embodiment of the present invention, the process comprises the step of allowing said heavy hydrocarbon feedstock to contact with the particulate material to form a product mixture and a coke laden particulate material comprises maintaining the heavy hydrocarbon feedstock and the particulate material in a conversion zone of the reactor chamber.

The present invention also provides a system for coking and simultaneous upgrading of a heavy hydrocarbon feedstock, comprising:

a reactor defining a chamber;

a particulate material supply means for supplying heated particulate material to the reactor chamber;

a hydrocarbon feedstock supply means for dispensing pre-heated heavy hydrocarbon feed stock to the reactor chamber such that the same comes in contact with the particulate material;

a product withdrawal means for withdrawing the product thus formed in the reactor chamber, characterized in that:

the hydrocarbon feed stock supply means dispenses the preheated heavy hydrocarbon feed stock as an atomized spray in the reactor chamber; and the reactor chamber allows the heated heavy hydrocarbon feedstock to stay in contact with the particulate material for a predetermined amount of time period such that the product comprises about 70 wt % to about 80 wt % of hydrocarbon having boiling point in the range of 40 to 600° C.

In one embodiment of the present invention, the system further comprises a velocity controlling means for controlling a velocity of the coke laden particulate material and/or controlling a velocity of the regenerated particulate material.

In one embodiment of the present invention, the system having the velocity controlling means comprises a first cyclone device for reducing the velocity of the coke laden particulate material and a second cyclone device for reducing the velocity of the regenerated particulate material.

In another embodiment of the present invention, the first and the second cyclone device are the same.

According to the present invention there is provided a circulating fluid bed cum delayed coking process for upgrading a heavy hydrocarbon feedstock comprising:

i) introducing a particulate heat carrier into an upflow or a downflow reactor and contacting the heavy hydrocarbon feedstock;

ii) ratio of the particulate heat carrier to feedstock is from about 4:1 to about 20:1;

iii) allowing the heavy hydrocarbon feedstock to contact with the heat carrier with a residence time of in the range of 60-900 second with more preferably in the range of 60-600 second and most preferably in the range of 0-300 second to produce a product stream;

iv) separating the product stream from the particulate heat carrier;

v) regenerating the particulate heat carrier;

vi) and collecting a gaseous and liquid product from the product stream, wherein the liquid product exhibits an increased API gravity, a reduced pour point, reduced viscosity and a reduced level of contaminants over that of said feedstock. Preferably, the loading ratio of the method as outlined above is from about 4:1 to about 20:1.

This invention also includes the method as outlined above wherein the heavy hydrocarbon feedstock is either Vacuum Residue or bitumen. Furthermore, the feedstock is preheated prior to its introduction into the upflow/down flow reactor.

The present invention also relates to the method as defined above, wherein the temperature of the upflow/downflow reactor is less than 750° C., wherein the pressure is atmospheric to about 3 kg/cm2 (g), and wherein the particulate heat carrier is alumina/silica or mixture or individual material having high heat capacity.

This invention is also directed to the above method wherein the contaminants, including Conradson carbon (coke), BS&W, nickel and vanadium are removed from the feedstock or deposited onto the heat carrier incorporated with weak acid sites.

The present invention is also directed to an upgraded heavy hydrocarbon feedstock characterized by the following properties: i) an API gravity from about 13 to about 23 and feed CCR in the range of 0.1-30 wt %; ii) a density from about 0.88 to about 0.98gm/cc; iii) a viscosity at 40° C. centi stokes (cSt) from about 15 to about 300 cSt; and iv) feed containing vanadium content of about 20 to 200 ppm; and v) teed containing Nickel content of about 10 to 100 ppm. More preferably, present invention is restricted for processing feed heavier than 20 wt % CCR feed.

The present invention also pertains to a liquid product obtained is in the range of 70-80 wt % with coke yield in the range of 10-20 wt %. More preferably present invention provides reduction in coke yield by about 10 wt % with increase in 10 wt % liquid yield.

This invention also includes an upflow/down flow reactor for heavy hydrocarbon feedstock upgrading comprising: i) a means for pre-heating the heavy hydrocarbon feedstock; ii) at least one injection means at least one of a plurality of locations along the upflow reactor, the at least one injection means for introducing the heavy hydrocarbon feedstock into the upflow reactor; iii) un inlet for introducing a particulate heat carrier, the inlet located below the at least one injection means, the particulate heat carrier present at a loading ratio of at least 4:1; iv) a conversion section within the upflow reactor; v) a separation means at an outlet of the upflow reactor to separate the gaseous and liquid products from the particulate heat carrier; vi) a particulate heat carrier regeneration means; vii) a particulate heat carrier recirculation line from the regeneration means to the inlet for supplying the particulate heat carrier to said mixing section; viii) a condensing means for cooling and condensing the liquid products;

The present invention also relates to the upflow reactor as defined above, wherein the plurality of locations, includes locations distributed along the length of said reactor. Furthermore, the upflow reactor may comprise a hot condenser means prior to the condensing means. Preferably, the loading ratio is from about 4:1 to about 20:1. The upflow reactor as defined above may also comprise a heavy fraction product recirculation means from the hot condensing means to the injection means of the upflow reactor.

According to the process of the present invention the regeneration of the particulate heat carrier is done only to the extent of 10-30% by weight, while balance 70-90% of heat carrier material is replaced with fresh material.

As per the invention, high heat carrier material of porous acidic clay bonded by alumina with a diluent normal clay, silica and aluminum trihydrate. The porous acidic clay can be produced insitu after calcination of shaped catalyst from kaolinite, bentonite, vermiculite, smectite, montmorillonite, sepiolite and hectorite. Natural beneficiated, clay can be in finely divided form with a size below about 5 microns. Clay can have a two-layer structure having alternating sheets of silica in tetrahedral configuration and alumina in octahedral configuration. These sheets are separated with a gap of 7.13 Å. Dry atmosphere equilibrated clay has moisture content of about 15 wt %. The clay is a good source for silica and alumina with about 45 wt % of silica and 38 wt % of alumina with empirical formula $2SiO_2—Al_2O_3.2H_2O$. Clay possesses surface area in the range 10-20 $m^2/g$ and as such does not have any catalytic activity. According to the present invention, this clay has been transformed to porous mild acidic material through high temperature calcination between 500° C. to 1000° C. followed by controlled mineral acid leaching, acid sourced from hydrochloric acid, nitric acid, sulphuric acid, hydrofluoric acid, phosphoric acid and their mixture. Calcined clay can be used or alternately normal clay containing catalyst can be subjected to high temperature calcination while acid leaching is performed on shaped catalyst employing adequate binder and fillers. Acid leaching of catalyst can pores in the range 20-1000 Å with mild acidity accessible to large hydrocarbon molecules suitable for cracking heavy resin and alkyl aromatics, heavy naphthenic molecules present in heavy feeds.

In accordance with the process of the present invention, the yield of the liquid is greater than 70% by weight due reduction in side branch of Poly Aromatic ring chain structure at the edge and reduce the coke make thereby increasing the liquid through use of a heat carrier having weak acid site that can easily be regenerated thereby enabling the process to convey adequate heat energy for sustaining continuous reaction.

The heat carrier of the present invention is of porous acidic clay that can be produced after calcination and then acid leaching on shaped catalyst (kaolinite, bentonite, illite, vermculite, smectite, montmorillonite). This heat carrier material have specialty to crack the heavier hydrocarbon aromatic ring structure at the edge so as to reduce the coke yield and increase the liquid yield. Normally the cracking does not take at the edge of the ring leading to high coke yield.

According to present invention the liquid product obtained is in the range of 70-80 wt % with coke yield in the range of 10-20 wt %. Further unwanted bottom and coke yield decreases with increase in liquid yield. The present invention has ability to process heavier feedstock with high CCR 20-30 wt % with reduction in coke yield. Typically coke yield is 1.6 time the CCR. In the present invention coke yield with 20 CCR feed is about 20 wt % only and with 10 wt % CCR about 10 wt % only. This is mainly attributed to weak acid site catalyst and process condition.

Table 1 provides result for experiments, which were conducted using VR having CCR 23 wt %. Experiments were conducted at three temperatures i.e, 490, 500 and 510° C., using optimized catalyst formulation at atmospheric pressure.

TABLE 1

| | Base | Base + HC | Base | Base + HC | Base | Base + HC |
|---|---|---|---|---|---|---|
| Temperature ° C. | 490 | 490 | 500 | 500 | 510 | 510 |
| Gas | 10 | 12 | 12 | 14 | 14 | 15 |
| Liquid | 60 | 68 | 58 | 65 | 55 | 63 |
| Coke | 30 | 20 | 30 | 21 | 31 | 22 |
| | 100 | 100 | 100 | 100 | 100 | 100 |

*HC Heat Carrier

As can be seen from above table that about 10 wt % of liquid yield is increases. These liquid is valuable product to improve the refinery profitability.

Figure 2:
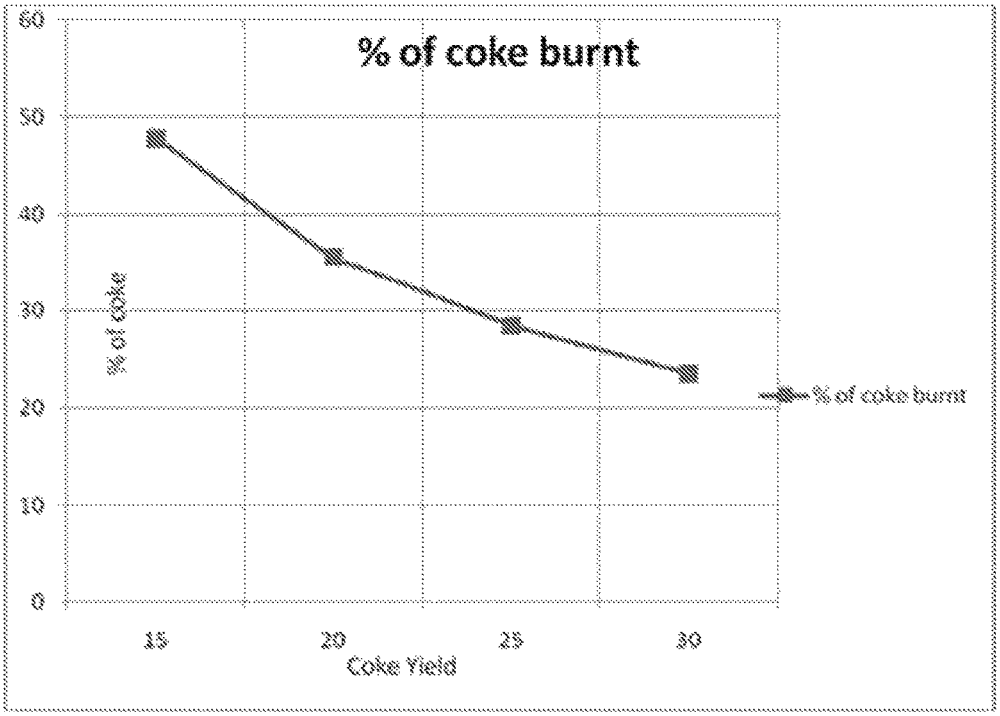
FIG. 2 illustrates graph of coke yield, wt % with respect to % of coke burnt.

Table 2 illustrates coke required to be burnt for heat balance and e graph for the same is provided as FIG. 2.

TABLE 2

| Coke yield, wt % | 30 | 25 | 20 | 15 |
|---|---|---|---|---|
| % of coke burnt | 23.5 | 28.4 | 35.6 | 47.8 |

The process and apparatus does not require any external heat for the operation. In situ heat is generated depending on the feed CCR processed. Accordingly, % of coke burnt can be known and optimum heat recovery could be achieved. It can observed from Table-2 and FIG. 2 that higher the feed heaviness in terms of CCR lower % of coke is required to be burnt for maintaining the process condition and lower the feed heaviness higher % of coke is required to be burnt.

We claim:

1. A process for coking and simultaneous upgrading of a heavy hydrocarbon feedstock, comprising:

a. providing a heated particulate material to a reactor chamber;

b. dispensing preheated heavy hydrocarbon feedstock in the reactor chamber such that the same comes in contact with the particulate material at a temperature in the range of 480° C. to 620° C.;

c. allowing said heavy hydrocarbon feedstock to stay in contact with the particulate material for a predetermined time period to form a product mixture and a coke laden particulate material;

d. withdrawing the product mixture from the reactor chamber; and e. regenerating 10 to 30 wt % of the coke laden particulate material and recirculating the regenerated particulate material with reduced velocity using a first cyclone device and a second cyclone device to the reactor chamber, wherein the first and the second cyclone device are the same;

wherein:

the preheated heavy hydrocarbon feedstock is dispensed as an atomized spray in the reactor chamber;

the predetermined time period is such that the product comprises about 70 wt % to about 80 wt % of hydrocarbons having boiling point in the range of about 40 to 600° C.; and the particulate material has specific area in the range of 100 to 200 $m^2$/gm; Heat capacity in the range of 0.9 to 1.0 KJ/Kg °C.; acidity of more than mass equivalent per gram and apparent bulk density of 0.7 to 1.0 gm/cc.

2. The process as claimed in claim 1, wherein the particulate material comprises a modified clay component, a binder component and optionally a diluent material, wherein the binder has less than 0.1 wt % of soda.

3. The process as claimed in claim 2, wherein the modified clay is selected from modified kaolinite, modified bentonite, modified illite, modified vermiculite, modified smectite, modified montmorillonite, modified sepiolite, modified hectorite and mixtures thereof.

4. The process as claimed in claim 2, wherein the binder is selected from the group comprising of alumina and the alumina is selected from alumina gel, psedobohemite, aluminium trihydrate, eta, theta and gamma.

5. The process as claimed in claim 2, wherein the diluent material is selected from non-modified clay, silica and aluminium trihydrate.

6. The process as claimed in claim 1, wherein the predetermined time period is in excess of about 60 seconds.

7. The process as claimed in claim 1, wherein the predetermined time period is maintained in the range of about 60 to about 900 seconds.

8. The process as claimed in claim 1, wherein the predetermined time period is maintained in the range of about 60 to about 600 seconds.

9. The process as claimed in claim 1, wherein the predetermined time period is maintained in the range of about 60 to about 300 seconds.

10. The process as claimed in claim 1, wherein a temperature during the predetermined period is maintained in the range of about 480° C. to 590° C.

11. The process as claimed in claim 1, wherein an amount of preheated heavy hydrocarbon feedstock provided to the reactor chamber is such that a loading ratio of said heated particulate material to said preheated heavy hydrocarbon feedstock is in the range of 4:1 to 20:1.

12. The process as claimed in claim 1, wherein the heavy hydrocarbon feedstock has a CCR content in excess of about 20 wt %.

13. The process as claimed in claim 1, wherein the heavy hydrocarbon feedstock is selected from the group comprising of heavy oil, bitumen or mixtures thereof.

14. The process as claimed in claim 1, further comprising separating the product mixture to obtain a light fraction and a heavy fraction and optionally recirculating at least a part of the heavy fraction to the reactor chamber.

15. The process as claimed in claim 14, wherein the step of separating the product mixture to obtain a light fraction and a heavy fraction is performed in a condenser.

16. The process as claimed in claim 1, further comprising controlling a velocity of the coke laden particulate material and/or controlling a velocity of regenerated particulate material.

17. The process as claimed in claim 1, wherein the reactor chamber is in the form of an upflow reactor.

18. The process as claimed in claim 1, wherein the step of providing a particulate material to the reactor chamber comprises maintaining the particulate material in form of a fluidized bed in the reactor chamber.

19. The process as claimed in claim 18, wherein maintaining the particulate material in form of a fluidized bed in the reactor chamber comprises feeding a fluidizing medium via at least one inlet located at a first elevation of the reactor chamber and feeding the particulate material via at least one inlet located at a second elevation of the reactor chamber.

20. The process as claimed in claim 1, wherein the step of dispensing preheated heavy hydrocarbon feedstock in the reactor chamber comprises dispensing the heavy hydrocarbon feedstock as an atomized spray from at least a top end of the reactor chamber.

21. The process as claimed in claim 1, wherein the step of dispensing preheated heavy hydrocarbon feedstock in the reactor chamber comprises dispensing the heavy hydrocarbon feedstock as an atomized spray from a plurality of elevations within the reactor chamber.

22. The process as claimed in claim 1, wherein the step of allowing said heavy hydrocarbon feedstock to contact with the particulate material to form a product mixture and a coke laden particulate material comprises maintaining the heavy hydrocarbon feedstock and the particulate material in a conversion zone of the reactor chamber.

* * * * *